US005183385A

United States Patent [19]

Lee et al.

[11] Patent Number: 5,183,385

[45] Date of Patent: Feb. 2, 1993

[54] TURBINE BLADE SQUEALER TIP HAVING AIR COOLING HOLES CONTIGUOUS WITH TIP INTERIOR WALL SURFACE

[75] Inventors: Ching-Pang Lee, Cincinnati; Harold P. Rieck, Jr., West Chester; Nicholas C. Palmer, Loveland; David G. W. Fargher, Fairfield, all of Ohio

[73] Assignee: General Electric Company, Cincinnati, Ohio

[21] Appl. No.: 830,975

[22] Filed: Feb. 10, 1992

Related U.S. Application Data

[63] Continuation of Ser. No. 615,520, Nov. 19, 1990, abandoned.

[51] Int. Cl.[5] ..... F01D 5/18

[52] U.S. Cl. ..... 416/97 R; 415/115

[58] Field of Search ..... 415/115, 116; 416/96 R, 416/96 A, 97 R, 92, 90 R, 90 A

[56] References Cited

U.S. PATENT DOCUMENTS

| | | | |
|---|---|---|---|
| 3,527,543 | 9/1970 | Howald | 416/90 |
| 3,848,307 | 11/1974 | Kydd | 416/96 R |
| 3,867,068 | 2/1975 | Corsmeier et al. | 416/97 R |
| 3,899,267 | 8/1975 | Dennis et al. | 416/96 R |
| 4,010,531 | 3/1977 | Andersen et al | 416/97 R |
| 4,247,254 | 1/1981 | Zelahy | 416/97 R |
| 4,726,104 | 2/1988 | Foster et al. | 416/97 R |
| 4,893,987 | 1/1990 | Lee et al. | 416/92 |

*Primary Examiner*—John T. Kwon

*Attorney, Agent, or Firm*—Jerome C. Squillaro

[57] ABSTRACT

A turbine blade squealer tip has a plurality of holes defined through the end cap of the blade tip portion and located contiguous with an interior surface of the squealer tip wall along at least one of the turbine blade pressure and suction sides of the tip cap for providing effective cooling air on the squealer tip wall. Each tip hole has an inner portion which communicates with the interior of the blade and an outer portion which communicates with a cavity defined by the blade end cap and the peripheral wall of the squealer tip. The cross-section of the inner hole portion is circular and the inner hole portion overall defines a right cylinder. The cross-section of the outer hole portion is rectangular and the outer hole portion overall defines a rectangular trapezoid.

12 Claims, 3 Drawing Sheets

TURBINE BLADE SQUEALER TIP HAVING AIR COOLING HOLES CONTIGUOUS WITH TIP INTERIOR WALL SURFACE

This is a continuation application under 37 CFR 1.62 of pending prior application Ser. No. 07/615,520, filed Nov. 19, 1990 now abandoned.

BACKGROUND OF THE INVENTION

1. Field of the Invention

The present invention relates generally to gas turbine engine blades and, more particularly, to a turbine blade squealer tip having air cooling holes through the tip end cap and arranged contiguous with the tip interior wall surface adjacent at least one of the pressure and suction sides of the blade.

2. Description of the Prior Art

It is well known that a reduction in gas turbine engine efficiency results from leaking of hot expanding combustion gases in the turbine across a gap between rotating turbine blades and stationary seals or shrouds which surround them. The problem of sealing between such relatively rotating members to avoid loss in efficiency is very difficult in the turbine section of the engine because of high temperatures and centrifugal loads. One method of improving the sealing between the turbine blade and shroud is the provision of squealer type tips on turbine blades. A squealer tip is composed of a continuous tip wall of relatively small height surrounding and projecting outwardly from an end cap on the outer end of a turbine blade which closes a cooling air plenum in the interior of the blade.

During operation of the engine, temperature changes create differential rates of thermal expansion and contraction on the blade rotor and shroud which may result in rubbing between the blade tips and shrouds. Centrifugal forces acting on the blades and structural forces acting on the shrouds create distortions thereon which may also result in rubs. Such rubbing interference between the rotating blade tips and surrounding stationary shrouds causes heating of the blade tips resulting in excessive wear or damage to the blade tips and shrouds. It is, therefore, desirable to cool the blade tips. However, in the case of squealer type blade tips, heating produced by such rubbing interference is actually augmented by the presence of a cavity defined by the end cap of the blade and the peripheral wall of the squealer tip. Therefore, squealer type blade tips, though fostering improved sealing, actually require additional cooling.

Because of the complexity and relative high cost of replacing or repairing turbine blades, it is desirable to prolong as much as possible the life of blade tips and respective blades. Blade tip cooling is a conventional practice employed for achieving that objective. The provision of holes for directing air flow to cool blade tips is known in the prior art, for instance as disclosed in U.S. Pat. No. 4,247,254 to Zelahy, and have been applied to squealer type blade tips as disclosed in U.S. Pat. No. 4,540,339 to Horvath.

Turbine engine blade designers and engineers are constantly striving to develop more efficient ways of cooling the tips of the turbine blades to prolong turbine blade life and reduce engine operating cost. However, cooling air used to accomplish this is expensive in terms of overall fuel consumption. Thus, more effective and efficient use of available cooling air in carrying out cooling of turbine blade tips is desirable not only to prolong turbine blade life but also to improve the efficiency of the engine as well, thereby again lowering engine operating cost.

One recent improvement in the blade tip cooling holes to achieve enhanced cooling of blade tips and thereby improved engine operating efficiency and blade tip life is disclosed in U.S. Pat. No. 4,893,987 to Lee et al, which is assigned to the assignee of the present invention. This improvement, which is described later in the prior art section of the detailed description, constitutes a positive step toward better blade tip cooling. However, there is a continuing need for additional improvements in this area of turbine blade design.

SUMMARY OF THE INVENTION

The present invention provides an arrangement of cooling air holes associated with a turbine blade squealer tip designed to satisfy the aforementioned need.

In accordance with the present invention, the turbine blade squealer tip has a plurality of holes defined through the end cap of the blade tip portion and located contiguous with an interior surface of the squealer tip wall at least along one of the turbine blade pressure and suction sides of the tip cap for providing effective cooling air on the squealer tip wall.

More particularly, each tip hole has an inner portion which communicates with the interior of the blade and an outer portion which communicates with a cavity defined by the blade end cap and the peripheral wall of the squealer tip. Specifically, the outer portion of the tip hole communicates with that portion of the cavity which is adjacent to the squealer tip wall at least along the turbine blade pressure side. Still further, the inner hole portion at an outer end thereof merges with and opens at an interior surface of the end cap and the outer hole portion at an outer end thereof merges with and opens at an exterior surface of the end cap. The inner and outer hole portions at respective inner ends thereof merge into one another.

The inner hole portion along its axial extent from its outer end to inner end has a cross-section with first and second orthogonal dimensions that are uniform. The outer hole portion along its axial extent from its outer end to inner end has a cross-section with a first dimension that is uniform and a second dimension orthogonal to the first dimension that decreases. Preferably, the cross-section of the inner hole portion is circular and the inner hole portion overall defines a right cylinder. The cross-section of the outer hole portion is rectangular and the outer hole portion overall defines a rectangular trapezoid.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
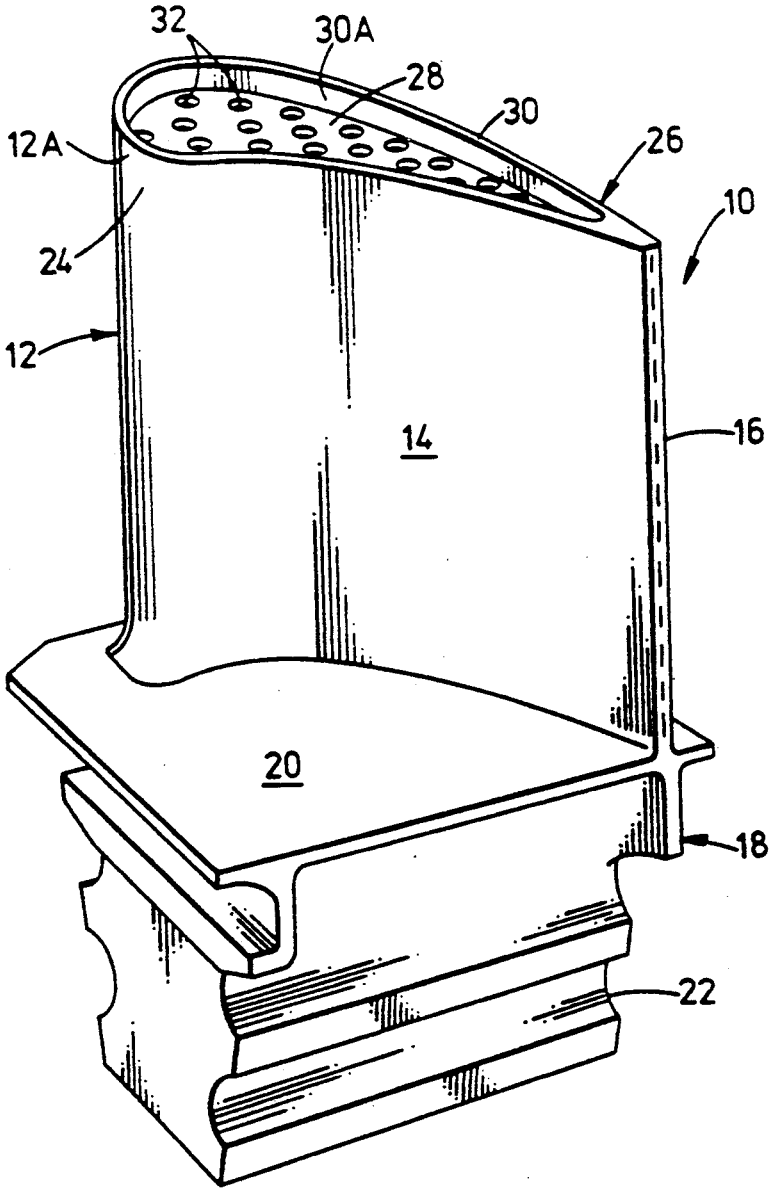
FIG. 1 (PRIOR ART)
FIG. 1 is a perspective view of a prior art turbine blade having a squealer tip with cooling holes through an end cap of the blade.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Prior Art Gas Turbine Engine Blade

Figure 2:
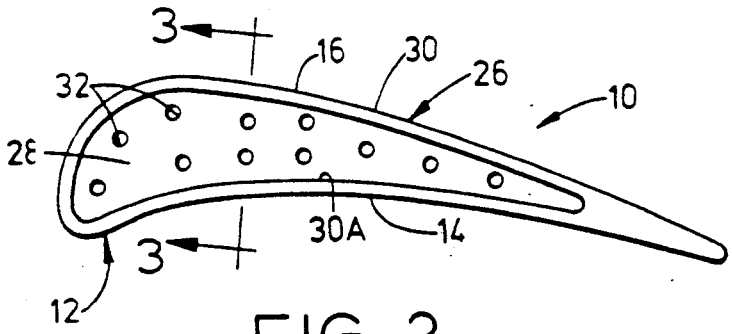
FIG. 2 (PRIOR ART)
FIG. 2 is a top plan view of the turbine blade of FIG. 1.

Referring now to the drawings, and particularly to FIGS. 1 and 2, there is illustrated a prior art gas turbine engine hollow rotor blade, being generally designated by the numeral 10. The blade 10 includes an airfoil 12 having a pressure side 14 and a suction side 16, and a base 18 mounting the airfoil 12 to a rotor (not shown) of the engine (not shown). The base 18 has a platform 20 rigidly mounting the airfoil 12 and a dovetail root 22 for attaching the blade 10 to the rotor.

At an outer end portion 24, the airfoil 12 of the blade 10 has a squealer tip 26. The squealer tip 26 is composed of an end cap 28 which closes the outer end portion 24 of the hollow blade 10, and a wall 30 attached to, and extending along the periphery 12A of, and projecting outwardly from, the end cap 28. The end cap 28 of the squealer tip 26 is provided with an arrangement of tip cooling holes 32 formed therethrough for permitting passage of cooling air flow from the interior of the blade 10 through the end cap 28 for purposes of cooling the blade squealer tip 26.

Prior Art Cooling Hole Arrangements

Figure 3:
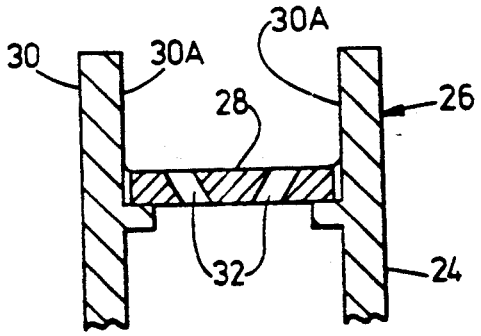
FIG. 3 (PRIOR ART)
FIG. 3 is an enlarged fragmentary sectional view of the prior art turbine blade squealer tip taken along line 3—3 of FIG. 2 showing a separate end cap having an arrangement of prior art angular impingement cooling holes formed therethrough.

Referring to FIG. 3, there is illustrated the prior art blade 10 with the end cap 28 being a separate constructed piece. The end cap 28 is cast separately from the airfoil 12 and the tip cooling holes 32 are drilled before the end cap 28 is attached, such as by brazing, on the outer end portion 24 of the airfoil 12.

This operation allows the cooling holes 32 to be drilled at an inclined angle, providing angular impingement of cooling air against the interior surface 30A of the squealer tip wall 30. Each of the cooling holes 32 are spaced a short distance inwardly from the wall interior surface 30A.

Figure 4:
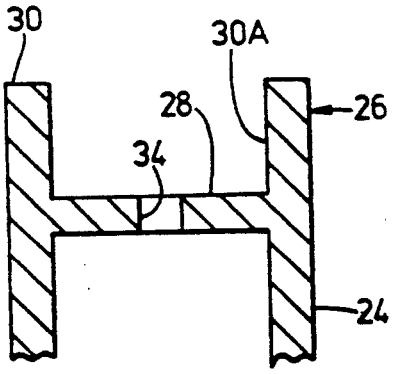
FIG. 4 (PRIOR ART)
FIG. 4 is a view similar to FIG. 3 of the prior art turbine blade squealer tip showing an integral end cap having an arrangement of prior art non-impingement cooling holes formed therethrough.

Referring to FIG. 4, there is illustrated the prior art blade 10 with the end cap 28 integrally attached to the airfoil 12. The end cap 28 has a plurality of non-impingement cooling holes 34 formed therethrough and spaced equidistantly from opposing portions of the squealer tip continuous wall 30. The cooling holes 34 extend perpendicular to the end cap 28 and generally parallel to the squealer tip wall 30. Although this construction reduces manufacturing costs of the squealer tip holes 34, they can no longer provide impingement cooling on the wall 30. The squealer tip 26 thus becomes hotter and requires more cooling air.

Figure 5:
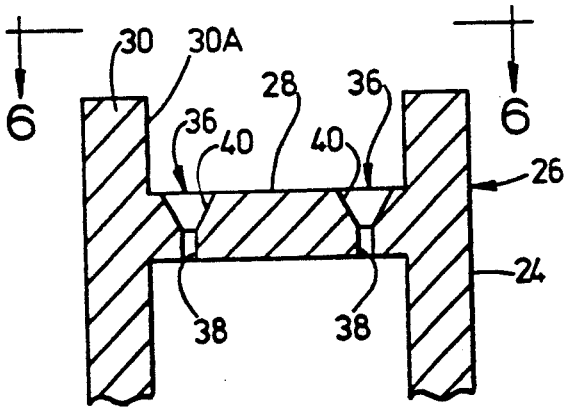
FIG. 5 (PRIOR ART)
FIG. 5 is another view similar to FIG. 3 of the prior art turbine blade squealer tip showing an integral end cap having an arrangement of prior art diffusion cooling holes formed therethrough.
Figure 6:
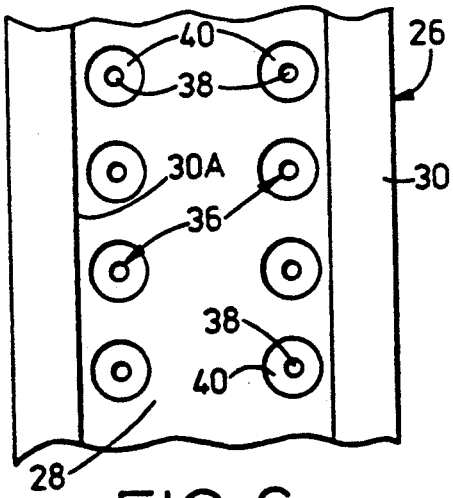
FIG. 6 (PRIOR ART)
FIG. 6 is a top plan view of the turbine blade squealer tip as seen along line 6—6 of FIG. 5.

Referring to FIGS. 5 and 6, there is illustrated the prior art blade 10 with the end cap 28 again integrally attached to the airfoil 12. The end cap 28 now has a plurality of diffusion cooling holes 36 formed through the blade end cap 28 and spaced closer to one than the other of opposing portions of the squealer tip continuous wall 30. These holes 36 are substantially identical to the ones discloses in U.S. Pat. No. 4,893,987, the disclosure of which is incorporated herein by reference. Suffice it to say, the diffusion holes 36 have a radially inner cylindrical portion 38 and a radially outer conical section 40. The diffusion cooling holes 36 are designed to diffuse or lower the velocity of the cooling air passing through them. The efficiency of the diffusion cooling holes 36 is further enhanced by the funnel shape thereof. These holes 36 are also spaced inwardly from the peripheral wall 30 of the squealer tip 26.

Cooling Hole Arrangement of Present Invention

Figure 7:
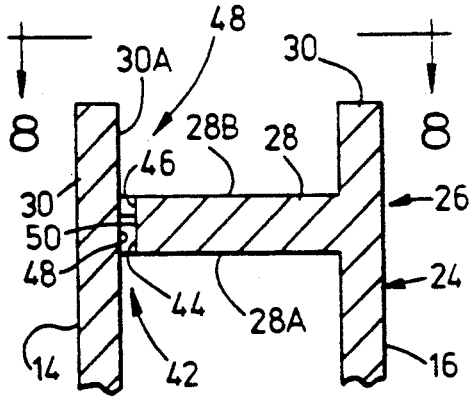
FIG. 7 is still another view similar to FIG. 3 of a turbine blade squealer tip showing an integral end cap with an arrangement of squealer tip wall cooling holes in accordance with the present invention along the pressure side of the blade only.
Figure 8:
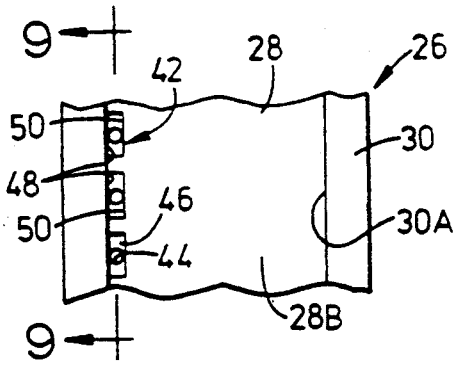
FIG. 8 is a top plan view of the turbine blade squealer tip of FIG. 7.
Figure 9:
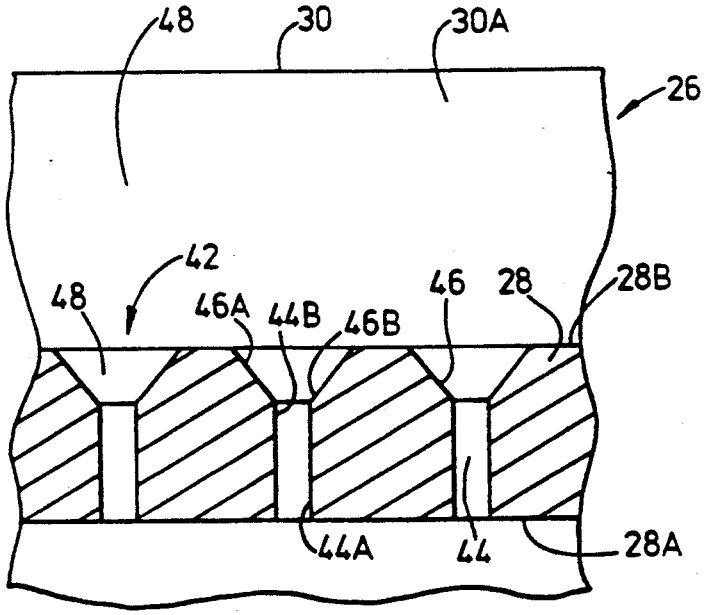
FIG. 9 is an enlarged sectional view taken along line 9—9 of FIG. 8.
Figure 10:
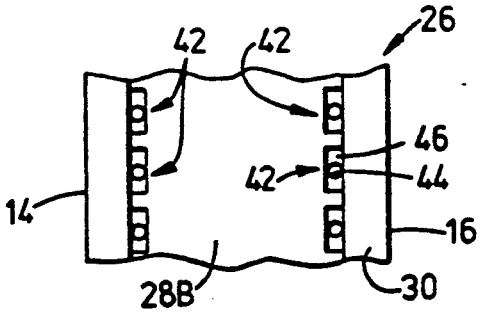
FIG. 10 is a view similar to FIG. 8 illustrating an arrangement of squealer tip wall cooling holes in accordance with the present invention along both pressure and suction sides of the blade.

Turning now to FIGS. 7-9, there is illustrated a blade 10 with an end cap 28, preferably being integrally formed on the outer end portion 24 of the airfoil 12. In accordance with the present invention, a row of squealer tip wall cooling holes 42 are formed through the end cap 28 along the pressure side 14 of the blade 10 only. FIG. 10 illustrates the same diffusion cooling holes 42 formed along both pressure and suction sides 14, 16 of the blade 10.

The diffusion holes 42 are defined through the end cap 28 in communication with the interior of the blade 10 through which cooling air flows in a conventional manner. As is conventional, the squealer wall 30 is connected to, extends around, and projects radially from the peripheral edge 12A of the outer end portion 24 of the blade airfoil 12. The holes 42 are spaced apart from each other and located contiguous with the interior surface 30A of the squealer wall 30. In the preferred embodiment, the holes 42 are aligned along the pressure side 14 of turbine blade 10 for providing effective cooling air flow from the holes 42 onto the interior wall surface 30A at the hottest portions of the squealer wall 30, which is along the pressure side 14 of the blade 10.

Referring to FIG. 9, each tip hole 42 basically includes an inner portion 44 communicating with the interior source of cooling air flow through the blade 10, and an outer portion 46 communicating with a cavity 48 defined by the blade end cap 28 and the peripheral wall 30 of the squealer tip 26. The outer hole portion 46 communicates with a portion of the cavity 48 located adjacent to and along the wall 30. The inner hole portion 44 has a lower outer end 44A merging with and opening at an interior surface 28A of the end cap 28 of the blade. The outer hole portion 46 has an upper outer end 46A merging with and opening at an exterior surface 28B of the end cap 28 of the blade 10. The outer hole portion 46 also is bordered by the interior wall surface 30A along one side. Opposite sides of the hole portion 46 are defined by spaced interior surface portions 48, 50. The one interior surface portion 48 of the outer hole portion 46 is formed on the pressure side 14 of the airfoil and extends in coplanar relation with the interior wall surface of the peripheral wall 30. The other interior surface portion 50 of the outer hole portion 46 is formed in the end can 28 and extends in a generally parallel relation to the one interior wall portion 48. Also, the inner and outer hole portions 44, 46 have respective adjacent inner ends 44B, 46B (upper inner end 44A and lower inner end 46B) merging into one another approximately at the mid-length of the hole 42.

Furthermore, as best seen in FIG. 9, the inner hole portion 44, along its axial extent from its lower outer end 44A to its upper inner end 44B has a cross-section with first and second orthogonal dimensions that are uniform. Preferably, the cross-section of the inner hole portion 44 is circular and the inner hole portion 44 overall defines a right cylinder. The outer hole portion 46, along its axial extent from its upper outer end 46A to its lower inner end 46B, has a cross-section with a first dimension that is uniform and a second dimension orthogonal to the first dimension that decreases. Preferably, the cross-section of the outer hole portion 46 is rectangular and the outer hole portion overall defines a rectangular trapezoid.

Thus, each tip hole 42 has a straight section or inner portion 44 near its entrance, and a diffusive section or outer portion 46 near its exit. The straight section has a minimum cross-sectional area to regulate the flow rate. The diffusive section 46 has an expanding funnel-shape of rectangular cross-sectional area to expand the cooling flow parallel to the squealer tip surface 30A and thus promote diffusion cooling thereof.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. In a turbine blade having an interior source of cooling air flow, opposite pressure and suction sides, and an end portion with a continuous peripheral edge, a squealer tip comprising:

(a) a peripheral wall connected to, extending around, and projecting from said peripheral edge of said end portion of said blade, said peripheral wall having an interior wall surface; and (b) means defining a plurality of tip holes through said end portion of said blade in communication with said interior source of cooling air flow, said tip holes being spaced apart from each other and located contiguous with said interior wall surface of said peripheral wall along at least one of said pressure and suction sides of said turbine blade for providing effective diffusion cooling air flow from said tip holes on a portion of said interior wall surface along said at least one of said pressure and suction sides of said blade;

(c) said each tip hole including (i) an inner portion having an inner end and an outer end and communicating with said interior source of cooling air flow of blade at said outer end, said inner hole portion along its axial extent from said outer end to inner end thereof having a cross-section with first and second orthogonal dimensions that are uniform, and (ii) an outer portion having an inner end and an outer end and communicating between said inner end of said inner portion of said hole and a cavity defined by said blade end portion and said peripheral wall of said squealer tip, said outer portion having opposite sides defined by spaced interior surface portions, one of said interior surface portions being formed on said at least one side of said blade and extending in coplanar relation with said interior wall surface of said peripheral wall, the other of said interior surface portions being formed in said end portion of aid blade and spaced from said one interior wall portion and extending in generally parallel relation thereto and to said one interior wall portion such that said outer hole portion along its axial extent from said outer end to inner end thereof has a rectangular cross-section with a first dimension that is uniform and a second dimension orthogonal to the first dimension that decreases so as to define said outer hole portion overall as a rectangular trapezoid.

2. The squealer tip as recited in claim 1, wherein said outer portion of each said tip hole communicates with a portion of said cavity being adjacent to said wall at least along said pressure side of said blade.

3. The squealer tip as recited in claim 1, wherein said outer end of said inner hole portion merges with and opens at an interior surface of said end portion of said blade.

4. The squealer tip as recited in claim 3, wherein said outer end of said outer hole portion merges with and opens at an exterior surface of said end portion of said blade.

5. The squealer tip as recited in claim 4, wherein said inner ends of said inner and outer hole portions merge into one another.

6. The squealer tip as recited in claim 1, wherein said cross-section of said inner hole portion is circular and said inner hole portion overall defines a right cylinder.

7. In a turbine blade having an interior source of cooling air flow, opposite pressure and suction sides, and an end portion with a continuous peripheral edge, a squealer tip comprising:

(a) a continuous peripheral wall connected to, extending around, and projecting from said peripheral edge of said end portion of said blade, said continuous peripheral wall having an interior wall surface; and (b) means defining a plurality of tip holes through said end portion of said blade in communication with said interior source of cooling air flow, said tip holes being spaced apart from each other and located contiguous with said interior wall surface of said continuous peripheral wall along respectively said pressure and suction sides of said turbine blade for providing effective diffusion cooling air flow from said tip holes on portions of said interior wall surface of said continuous peripheral wall along said pressure and suction sides of said blade;

(c) said each tip hole including (i) an inner portion having an inner end and an outer end and communicating with said interior source of cooling air flow of blade at said outer end, said inner hole portion along its axial extent from said outer end to inner end thereof having a cross-section with first and second orthogonal dimensions that are uniform, and (ii) an outer portion having an inner end and an outer end and communicating between said inner end of said inner portion of said hole and a cavity defined by said blade end portion and said peripheral wall of said squealer tip, said outer portion having opposite sides defined by spaced interior surface portions, one of said interior surface portions being formed on one of said pressure and suction sides of said blade and extending in coplanar relation with said interior wall surface of said peripheral wall, the other of said interior surface portions being formed in said end portion of said blade and spaced from said one interior wall portion and extending in generally parallel relation thereto and to said one interior wall portion such that said outer hole portion along its axial extent from said outer end to inner end thereof has a rectangular cross-section with a first dimension that is uniform and a second dimension orthogonal to the first dimension that decreases so as to define said outer hole portion overall as a rectangular trapezoid.

8. The squealer tip as recited in claim 7, wherein said outer portion of each said tip hole communicates with a portion of said cavity being adjacent to said wall along said pressure and suction sides of said blade.

9. The squealer tip as recited in claim 7, wherein said outer end of said inner hole portion merges with and opens at an interior surface of said end portion of said blade.

10. The squealer tip as recited in claim 9, wherein said outer end of said outer hole portion merges with and opens at an exterior surface of said end portion of said blade.

11. The squealer tip as recited in claim 10, wherein said inner ends of said inner and outer hole portions merge into one another.

12. The squealer tip as recited in claim 7, wherein said cross section of said inner hole portion is circular and said inner hole portion overall defines a right cylinder.

* * * * *